United States Patent [19]

Gale

[11] 4,290,216

[45] Sep. 22, 1981

[54] COMBINATION HORIZONTALLY AND VERTICALLY MOUNTED DISPLAY

[76] Inventor: Jean L. Gale, 44 Deer Path La., Weston, Mass. 02193

[21] Appl. No.: 163,989

[22] Filed: Jun. 30, 1980

[51] Int. Cl.[3] ..... G09F 1/12

[52] U.S. Cl. ..... 40/152.1; 248/470

[58] Field of Search ..... 40/152, 152.1; 248/126, 248/470, 558, 462

[56] References Cited

U.S. PATENT DOCUMENTS 464,053 12/1891 Wirths ..... 40/152.1
3,074,680 1/1963 Stewart ..... 40/152.1
3,251,572 5/1966 Klitzner ..... 248/470
3,865,342 2/1975 Kanzelberger ..... 40/152.1

*Primary Examiner*—Gene Mancene
*Assistant Examiner*—Wenceslao J. Contreras

[57] ABSTRACT

A display member capable of being supported on a horizontal surface in a first mode and on a hook member attached to a vertical surface in a second mode. A support for the display has a first portion joined at an angle to a longer second portion. When supported on a horizontal surface, the shorter portion is connected to the display. When supported on a hook member attached to a vertical surface, the longer portion is connected to the display.

12 Claims, 9 Drawing Figures

Fig. 3a
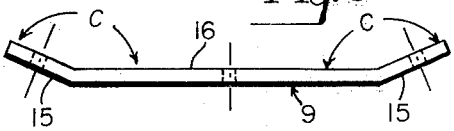
Fig. 3b
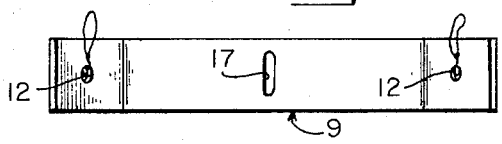
Fig. 4
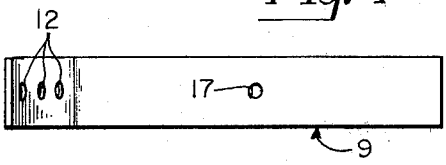
Fig. 5
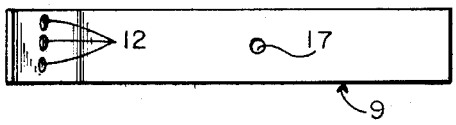
Fig. 6
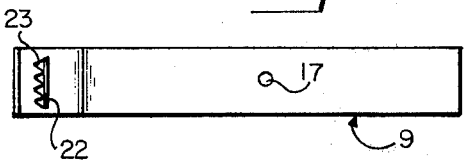
Fig. 7
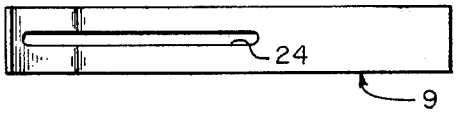
Fig. 8a
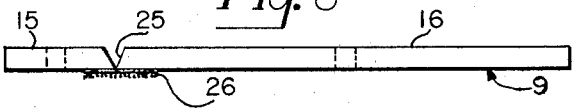
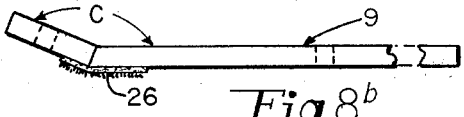
Fig. 8b
Fig. 9
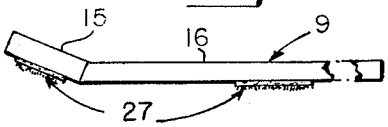

COMBINATION HORIZONTALLY AND VERTICALLY MOUNTED DISPLAY

BACKGROUND OF THE INVENTION

This invention relates to easels, hangers and display frames and has particular reference to combination easel and hanger devices that are attached to a picture frame member when in use. More specifically, this invention relates to display members that are especially suitable either for displaying framed pictures and the like at a slight angle from the vertical on horizontal surfaces or for hanging framed pictures and the like from generally vertical surfaces such as walls.

SUMMARY OF THE INVENTION

It is an object of this invention to provide an improved combination easel and hanger device for frames which is separable from the frame but which is attached to a frame member when in use.

It is another object of this invention to provide a combination easel and hanger device which when attached to a frame member and used in the easel mode is sturdy and provides a stable, secure, and yet adjustable and unobstrusive means, for displaying a substantially planar frame at variably selected angles from the vertical on a horizontal surface.

It is a further object of the invention to provide a combination easel and hanger device which when used in the easel or hanger mode permits framed pictures, printed material and the like to be displayed in the proper orientation for viewing or reading. Thus, for planar pictures or printed material which have vertical axes longer than their horizontal axes, the frame is readily oriented with its longer axis in the vertical position. Alternatively, in the easel or hanger mode, the frame is readily oriented with its longer axis in the horizontal position to accommodate and display properly items intended to be viewed in such orientation.

It is still a further object of this invention to provide a combination easel and hanger device which in the hanger mode provides a secure yet simple means for suspending or otherwise attaching the frame to a picture hook, nail, ceiling or wall-wire, or one or more other projections from the wall from which the framed object is to be hung.

It is also an object of this invention to provide a combination easel and hanger device which in the hanger mode does not cause the framed object to project too far from the wall, nor does it cause the frame to be tilted at an unacceptable angle with respect to the substantially vertical plane of the wall.

Further, it is an object of this invention to provide a combination easel and hanger device which can be easily disassembled to facilitate packaging and shipping. If shipped assembled, the device does not occupy too much space, in at least one of its assembled modes, to conserve packaging materials. If shipped disassembled, assembly is simple and tools are not required.

Another object of this invention is to provide a combination easel and hanger device which is very simple to change from the easel to the hanger mode and vice versa without taking the whole frame apart.

It is a still further object of this invention to provide a combination easel and hanger device which is suitable for use with frames which are substantially transparent or translucent. Accordingly, it is important that the means for attaching the combination easel and hanger to a frame member, and the combination easel and hanger itself, not be readily visible when viewed from the front of the assembled combination containing the item to be displayed.

Briefly stated, and according to an aspect of this invention, the foregoing objects are achieved by providing a combination easel and hanger device releasably attachable to a frame member for the purpose of displaying pictures and the like on horizontal surfaces or for hanging them on generally vertical wall surfaces.

BRIEF DESCRIPTION OF THE DRAWINGS

The invention both as to its organization and principles of operation together with further objects and advantages may better be understood by referring to the following detailed description of embodiments of the invention taken in conjunction with the accompanying drawings, in which:

FIGS. 3A and 3B are side and top views of another embodiment of the easel-hanger member, in accordance with this invention;

FIGS. 4, 5, 6, and 7 are top views of other embodiments of the easel-hanger member, in accordance with this invention;

FIG. 8A is a side view of still another embodiment of the easel-hanger member, in accordance with this invention;

FIG. 8B is a side view of the embodiment of the easel-hanger member of FIG. 8A, when in the easel mode, in accordance with this invention; and FIG. 9 is a side view of a further embodiment of the easel-hanger member, in accordance with this invention.

DESCRIPTION OF THE PREFERRED EMBODIMENT

Figure 1:
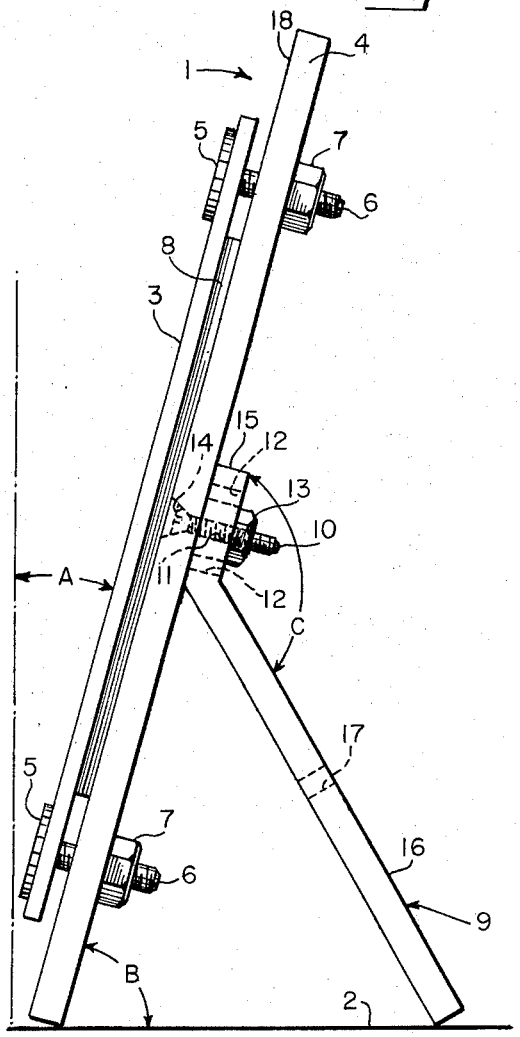
FIG. 1 is a side view of the combination easel and hanger device, in the easel mode, in accordance with this invention.

Referring to FIG. 1, a display member, when assembled in the easel mode, comprises an assembled frame 1 to display a picture 8 at a slight angle A from the vertical on a horizontal surface 2. A front frame member 3, preferably made from non-glare, transparent plastic or glass is secured to a transparent or translucent plastic or glass back frame member 4 by four decorative disks or emblems 5. The screw studs 6 of the emblems 5 extend through corresponding holes in the front frame member 3 and the back frame member 4 and serve as binding posts for nuts 7. When the nuts 7 are tightened, the picture 8 or other item to be displayed is securely sandwiched between the front frame member 3 and the back frame member 4. If desired, the front frame member 3, disks 5 with studs 6 and nuts 7 need not be used.

Easel-hanger member 9 is releasably and adjustably fastened to the back frame member 4 by a flat-headed screw 10. The screw 10 passes through a counter-bored hole 11, located in the geometric center of the back frame member 4, and through one of the holes 12 located in a shorter portion 15 of the easel-hanger member 9. Tightening nut 13 secures the easel-hanger member 9 to the flat-headed screw 10 and thus to the back frame member 4.

More than one hole 12 may be included in the shorter portion 15 of the easel-hanger member 9 to provide adjusting means to change the angle B of the frame with respect to the horizontal surface 2. A counter-bore 14 in the plane of the front surface 18 of the back frame member 4 permits the flat-headed screw 10 to be recessed or counter-sunk below the plane of the front surface 18 of the back frame member 4 to prevent the head of the flat-headed screw 10 from interfering with the picture 8 or other item to be displayed. The counter-bored hole 11 may be threaded to retain the flat-headed screw 10; or, there can be a press-fit between the screw 10 and the hole 11. Other means well known in the art may be used to retain the screw 10 in the hole 11. There may also be a clearance provided between the screw 10 and the hole 11 so that the screw 10 may be readily removed. Although a flat-headed screw 10 is preferred, nearly any shaped head may be used.

In the embodiment shown in FIG. 1, easel-hanger member 9 has a substantially flat, rigid shorter portion 15 rigidly joined at an angle C to a substantially flat, rigid longer portion 16. Angle C may be advantageously an obtuse angle of approximately 130°, although this is not critical. To change orientation of the longer axis of the frame 1 with respect to the easel-hanger member 9 in the easel mode of FIG. 1, it is only necessary to loosen the nut 13, rotate easel-hanger member 9 90°, and retighten the nut 13.

A hole 17 is provided approximately equi-distant between the free end of the short portion 15 and the free end of the longer portion 16 of easel-hanger member 9. Hole 17 is used to change the easel-hanger member 9 from the easel mode to the hanger mode (shown in FIG. 2).

The presence of the picture 8 in the completely assembled transparent or translucent frame 1 serves, when viewed from the front, to conceal the head of the screw 10, nut 13, and for all practical purposes, easel-hanger member 9, even though picture 8 is substantially smaller in both length and width than either front frame member 3 or back frame member 4.

Figure 2:
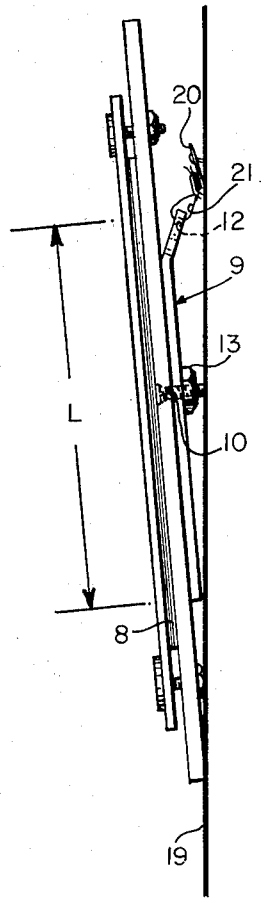
FIG. 2 is a side view of the combination easel and hanger device of FIG. 1, in the hanger mode, in accordance with this invention.

Referring now to FIG. 2, the combination easel-hanger member 9 and frame member 4 are assembled in the hanger mode. The completely assembled frame 1 displays a picture 8, by hanging, from a wall 19. To convert the easel-hanger member 9 from the easel mode illustrated in FIG. 1 to the hanger mode shown in FIG. 2, it is only necessary to remove nut 13, remove easel-hanger member 9 from screw 10 and to insert the screw 10 through the hole 17 in easel-hanger member 9 and to replace and tighten the nut 13. The easel-hanger member 9 can be aligned with either central axis of the frame 1 by simply loosening the nut 13, rotating easel-hanger member 9 90° as appropriate, and retightening the nut 13.

The frame 1 can be hung on a picture hook or nail 20 by allowing the hook 20 to extend through the hole 12 in the easel-hanger member 9. Optionally, a string or wire 21 may be looped through the hole 12 to attach the easel-hanger member 9 and thus frame 1 to hook 20.

It is known in the art to provide a variety of sizes of frames which may be generally rectangular, circular, or oval to accommodate a corresponding variety of sizes and shapes of pictures or other items to be displayed. When used in the hanger mode with a substantially transparent or translucent frame as shown in FIG. 2, it is preferable that the overall projected length L of the easel-hanger member 9 from the free end of the short portion 15 to the free end of longer portion 16 be no greater than the length of the shorter axis of the picture or other item to be displayed. Further, it is preferable that the width be no greater than the width of the picture or other item to be displayed so that picture 8 or the like will act to conceal the easel-hanger member 9 and related fastening and hanging means from sight when viewed from the front of the assembled frame 1.

When the easel-hanger member 9 of this invention is used in the hanger mode with a frame or picture which is not generally rectangular, the picture may be displayed in any orientation without seeing the easel-hanger member 9 when viewing the picture from the front. This will result providing that the hole 17 is connected to the geometric center of back frame member 4 and the longer portion 16 is not longer than the length of one-half of any axis of the member 4 through its geometric center.

The easel-hanger member 9 is made from any suitably rigid material of sufficient strength to prevent breaking, tearing or significant bending when in use such as plastic, metal, wood, etc. Advantageously, the easel-hanger member 9 is moulded or heat-formed from rigid, thermoplastic sheet. Alternatively, the angle C between shorter portions 15 and longer portion 16, as shown in FIG. 1, may be formed by cutting a transverse "V"-shaped portion partially through and across easel-hanger member 9 where the angle C is to be formed; heating and bending the plastic in the region near the "V" cut; bending the plastic shorter and longer portions 15 and 16 respectively to form angle C and then, optionally, glueing the joint so formed.

FIGS. 3A and 3B show two views of an embodiment of the easel-hanger member 9 which includes two angled shorter portions 15 at either end of one longer portion 16. Each shorter portion can form equal angles C or different angles with the longer portion. Each shorter portion 15 may include a hole or a plurality of holes 12. Shorter portions 15 may be of same or differing lengths. When used as an easel, only one such hole 12 is utilized to fasten the easel-hanger member 9 to back frame member 4 by the flat-headed screw 10. When used as a hanger, however, holes in both short portions 15 may be used to loop a wire or string or strings through. When used in this way, the easel-hanger member 9 is disposed horizontally to the plane of the floor. The central hole 17 may either be a single hole, a series of holes, or an elongated slot such as is shown in FIG. 3B. The easel-hanger 9 may also be used in the hanger mode disposed vertically to the floor, in which case, the second or lower shorter portion 15 serves as a spacing means to keep the frame from tilting excessively with respect to the wall.

FIG. 4 shows the easel-hanger member 9 including a plurality of holes 12 which are located along a common axis with hole 17. By selecting one of said plurality of holes 12, it is possible to adjust the angle B, shown in FIG. 1, with respect to the horizontal surface 2.

FIG. 5 shows another arrangement of holes 12 which can be used to balance the frame in the event that one side is slightly heavier than the other.

FIG. 6 shows an elongated opening 22, the upper portion of which is comprised of a number of saw-like serations or teeth 23 which enable the adjustment and straightening of the easel-hanger member 9 and thus the whole frame assembly 1 with respect to a picture hook.

FIG. 7 shows an easel-hanger member 9 in which holes 12 and 17 are combined into one continuous slot 24 to enable minute adjustments to be made when used either in the easel or hanger mode.

FIGS. 8A and 8B show still another embodiment of easel-hanger member 9. In this embodiment, the shorter portion 15 is actually cut and separated from the longer portion 16 by a miter angle of approximately 50° at 25, (although this angle is not critical). The portions 15 and 16 are butted as shown in side elevation in FIG. 8A. A piece of polyester tape 21 such as is sold commonly under the trade name "Mylar" is self-adhered to both portions 15 and 16. Easel-hanger members made in this fashion may be shipped entirely flat to save space and packaging material. Also, when used in the hanger mode, the frame assembly 1 will tend to conform more closely to the wall because of the flexibility of the joint between butting portions 15 and 16. When used in the easel mode, lower portion 16 of member 9 is extended until restrained by the effect of the tape 26 cooperating with the mitered, butted joint to restrain the mitered joint to angle C, as shown in FIG. 8B.

FIG. 9 shows another embodiment of an easel-hanger member 9. The associated frame member (not shown) uses a piece of fastening material commonly sold under the trade name "Velcro" in place of the counter-bored hole, flat-headed screw and nut previously described. Either the looped or hooked member of a pair of fastenable "Velcro" pieces is cemented or adhered to the approximate center of the back surface of the back frame member. Assuming that the "looped" form of the "Velcro" is used on the frame member, then pieces 27 of the opposite or "hooked" form of "Velcro" are cemented or adhered to the easel-hanger member 9. Using this method eliminates the need for all but one of the holes 12 and eliminates the need for hole 17 in member 9 as illustrated in FIG. 1. One hole 12 in shorter portion 15 of easel-hanger member 9 will still be required for hanging. This hole 12 may pass through the "Velcro". Otherwise, the easel-hanger member 9 is used substantially as previously described. However, instead of being screwed to back frame member 4, the easel-hanger member 9 is joined to back frame member 4 by pressing the two "Velcro" pieces together.

The preferred method for assembly of the embodiment as shown in FIGS. 1 and 2 is first to insert the flat-headed screw 10 into the counterbored hole 11 so that the head of the screw rests in the counter-bored portion 14 of the hole 11 and below the plane of the front surface 18 of back frame member 4. Second, the screw 10 is passed through the hole 12 for the easel mode or through the hole 17 for the hanger mode. Third, the nut 13 is placed upon the screw 10 and tightened to secure the member 9 in place. Fourth, the picture 8 is centered with respect to the front surface 18 of the back frame member 4. Next, the front frame member 3 is located so the emblems 5 can be passed through corresponding holes in front and back frame members. Nuts 7 are used to fasten the front and back frame members together, thus securely sandwiching the centered picture 8 between the front and back frame members 3 and 4, respectively.

It is possible to omit the front frame member 3, in which case the picture 8 or other item to be displayed may be fastened in any number of ways to the back frame member 4. When use is made of the flat-headed screw 10 to attach the easel-hanger member 9 to the back frame member 4, the screw 10 must be in place before the picture 8 or other item to be displayed is fastened to back frame member 4.

While embodiments and application of this invention have been shown and described, it will be apparent to those skilled in the art that many more modifications are possible without departing from the inventive concepts herein described. The invention, therefore, it not to be restricted except as necessary by the prior art and by the spirit of the appended claims.

What is claimed as new and desired to be secured by Letters Patent of the United States is:

1. A display member having a central horizontal axis and a 90° displaced vertical axis capable of being supported on a horizontal surface in a first mode and on a hook member attached to a vertical surface in a second mode comprising:

display means having a front viewing surface and a back surface;

support means capable of being readily displaced 90° with respect to said display means for supporting said display means on a horizontal surface when said support means is aligned with the central horizontal axis or the central vertical axis or on a hook member attached to a vertical surface when said support means is aligned with the central horizontal axis or the central vertical axis, said support means having first and second substantially flat, rigid, unbending portions, said first portion having a shorter length than said second portion, said first and second portions being joined at an angle, said first portion including a first fastening means and said second portion including a second fastening means; and connecting means located on said back surface of said display means for readily releasably connecting and attaching said first fastening means to said display means, to provide a display member capable of being supported on a horizontal surface and for readily releasably connecting and attaching said second fastening means to said display means to provide a display capable of being supported on the hook member attached to a vertical surface.

2. The display member as in claim 1 wherein in the second mode said second portion is of a length no greater than the length of one-half of any axis through the geometric center of said back surface wherein said support means is substantially blocked by said display means when viewed from said front viewing surface in the first or second mode.

3. The display member as in claim 2 wherein said first and second fastening means include a fastening fabric and said first portion of said support means includes an aperture for mounting on the hook member.

4. The display member as in claim 2 wherein said support means includes a third substantially flat and rigid portion, said third portion being joined to said second portion at an angle at an end opposite said first portion, said third portion serving as a spacing means to keep said display means a predetermined distance from the vertical surface in the second mode.

5. A display member having a central horizontal axis and a 90° displaced vertical axis for displaying an item capable of being supported on a horizontal surface, in a first mode, and on a hook member attached to a vertical surface, in a second mode, comprising:

display means including a substantially transparent front frame member, a substantially transparent back frame member, and means for securing said front frame member to said back frame member to sandwich the item therebetween;

support means capable of being readily displaced 90° with respect to said display means for supporting said display means on a horizontal surface when said support means is aligned with the central horizontal axis or the central vertical axis or on a hook member attached to a vertical surface when said support means is aligned with the central horizontal axis or the central vertical axis, said support means having first and second substantially flat, unbending and rigid portions, said first portion having a shorter length than said second portion, said first and second portions being joined at an angle, said first portion including a first aperture and said second portion including a second aperture; and connecting means for readily releasably connecting and attaching said back frame member to said support means through said first aperture in the first mode and through said second aperture in the second mode.

6. The display member as in claim 5 wherein in the second mode, said second portion of said support means is of a length no greater than the length of one-half of any axis through the geometric center of said back frame member wherein said support means is substantially blocked by said display means when viewed from said front frame member in the first or second mode.

7. The display member as in claim 6 wherein said first aperture is adapted to mount on the hook member attached to a vertical surface.

8. The display member as in claim 6 wherein said back frame member includes a counter-bored hole and said connecting means includes a flat-headed screw and a mating nut, said support means being rotatable 90° about said screw to change alignment between the central horizontal axis and the central vertical axis.

9. The display member as in claim 8 wherein said first portion of said support means includes a plurality of apertures.

10. The display member as in claim 8 wherein said first and second apertures are formed as an elongated slot.

11. The display member as in claim 5 wherein said support means includes a third substantially flat and rigid portion, said portion being joined to said second portion at an angle at an end opposite said first portion, said third portion serving as a spacing means to keep said display means a predetermined distance from the vertical surface in the second mode.

12. The display member as in claim 5 including a flexible member joining said first and second portions wherein the adjoining ends of said first and second portions are mitered.

* * * * *